US006286344B1

(12) United States Patent
Jeon et al.

(10) Patent No.: US 6,286,344 B1
(45) Date of Patent: Sep. 11, 2001

(54) WASHING MACHINE WITH TILTED TUB ASSEMBLY

(75) Inventors: Si Moon Jeon, Seoul; Dong Won Kim; Young Hwan Park, both of Kyungki-do; Oh Hun Kwon, Seoul; Kyung Hwan Kim, Kyungki-do; Tae Hee Lee, Seoul, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/272,128

(22) Filed: Mar. 19, 1999

(30) Foreign Application Priority Data

Feb. 4, 1999 (KR) ..... 99/3705
Feb. 4, 1999 (KR) ..... 99/3706
Feb. 4, 1999 (KR) ..... 99/3708
Feb. 4, 1999 (KR) ..... 99/3709
Feb. 4, 1999 (KR) ..... 99/3710

(51) Int. Cl.[7] ..... D06F 37/20
(52) U.S. Cl. ..... 68/23.1; 68/24; 68/173
(58) Field of Search ..... 68/23.1, 23.3, 68/24, 146, 173; 210/363, 364, 365

(56) References Cited

FOREIGN PATENT DOCUMENTS 491642 1/1974 (JP) .
5117373 2/1976 (JP) .
29694 * 2/1988 (JP) ..... 68/23.1
3280992 12/1991 (JP) .
7178287 7/1995 (JP) .

* cited by examiner

*Primary Examiner*—Philip R. Coe

(57) ABSTRACT

A washing machine with a tilted tub assembly is disclosed. In the washing machine, the tub assembly is suspended and supported within an upright housing at a predetermined angle relative to the perpendicular of the housing. The tilted position of the tub assembly within the housing is stably held by damper hangers, shock absorbing units and/or elastic support units. The tilted tub assembly is convenient to users while putting or taking laundry into or out of the tub assembly. The tilted tub assembly also forms complex and active water currents suitable for preventing laundry from being entangled during a washing operation. The washing effect of the washing machine is thus improved with a reduced deviation of the washing effect. The washing machine almost completely prevents its drive motor from being overloaded and conserves the operational time while washing laundry. This saves water and electric power during a washing operation.

7 Claims, 15 Drawing Sheets

WASHING MACHINE WITH TILTED TUB ASSEMBLY

BACKGROUND OF THE INVENTION

1. Field of the Invention

The present invention relates, in general, to washing machines used for washing clothes, sheets, etc. and, more particularly, to a washing machine with a tilted tub assembly, the tub assembly being tilted at a predetermined angle suitable for improving washing effect of the washing machine while reducing the deviation of the washing effect, and being convenient to users while putting or taking laundry into or out of the tub assembly.

2. Description of the Prior Art

As well known to those skilled in the art, washing machines are electric equipment used for washing laundry, such as clothes, sheets, etc. When laundry is continuously immersed in water, mixed with detergent, for a lengthy period of time without adding any mechanical action to the laundry, dirt of the laundry may be removed due to a chemical reaction of the detergent. However, a lengthy period of time is needed until dirt completely is removed. Therefore, in order to quickly wash laundry, it is necessary to add a mechanical action, such as friction and vibration, to the laundry by forcibly whirling detergent water with the laundry immersed in the water. Washing machines are for washing laundry while adding such a mechanical action to the laundry in detergent water.

FIG. 1 is a side sectional view, showing the construction of a typical washing machine. As shown in the drawing, the typical washing machine comprises a housing 10 and a washing tub assembly 20. The tub assembly 20 is installed inside the housing 10 and performs a washing operation. Four damper hangers 30 support the tub assembly 20 in the housing 10 while suspending the assembly 20 in said housing 10 and performing a damper function. The washing machine also has a drive motor 40 which rotates both a pulsator 25 and an inner tub 23 of the tub assembly 20.

The tub assembly 20 comprises two tubs: an outer tub 21 and an inner tub 23. The outer tub 21 has four regularly spaced brackets 22 at its lower portion, thus being caught by the lower ends of the four damper hangers 30 at the brackets 22. The tub 21 is thus held in the housing 10. On the other hand, the inner tub 23, densely perforated on its sidewall, is concentrically positioned inside the outer tub 21 with a pulsator 25 being interiorly integrated with the bottom of the inner tub 23. The above pulsator 25 is for improving washing effect of the machine.

The drive motor 40 is provided with both a clutch unit and a planetary gear mechanism, thus controlling a rotating action of the inner tub 23 integrated with the pulsator 25.

The four damper hangers 30 are caught by housing brackets 11, formed on the upper portion of the housing 10, at their top ends. The lower ends of the hangers 30 are individually caught by a tub bracket 22, formed on the lower portion of the outer tub 21, through a damper unit 35. The damper unit 35 comprises a hollow damper case 37, which is held by the tub bracket 22 at the upper portion and receives a coil spring 36, with a flanged lower end of the hanger 30 being stopped by the lower end of the spring 36 within the case 37.

Therefore, the tub assembly 20 is suspended within the housing 10 by the damper hangers 30.

The above washing machine is operated as follows.

Laundry, such as clothes, sheets, etc., is put into the perforated inner tub 23 of the tub assembly 20 prior to starting the washing machine. When the machine is started, water is supplied from a pipe line into the tub assembly 20 until the water reaches a predetermined level. Of course, the water level is determined in accordance with the volume of laundry. Thereafter, the drive motor 40 is started, thus rotating the inner tub 23 along with the pulsator 25. That is, a washing process is started.

When a preset time has passed after the motor 40 is started, the motor 40 is stopped. A drain valve 27, provided at a drain pipe 28 extending outwardly from the bottom of the tub assembly 20, is opened, thus discharging laundry wastewater from the tub assembly 20 through the drain pipe 28.

After the detergent water is completely discharged from the tub assembly 20, new water is supplied into the tub assembly 20 until the water reaches a predetermined level. A rinsing process is, thereafter, started. Such a rinsing process is performed twice or three times in each washing operation of the machine. In each of the rinsing processes, the washing machine performs the same operation as that of each washing process. However, in each rinsing process, the working time of the drive motor 40 is shorter than that of each washing process.

After the preset washing and rinsing processes are completely ended, the perforated inner tub 23 is rotated at a high speed so as to start a water-drainage process where the water soaked laundry is somewhat drained of water. In such a water-drainage process, the water-saturated laundry is centrifugally drained of water. The water, thereafter, passes from the inner tub 23 into the outer tub 21 through the perforations of the inner tub 23 due to a high speed rotating action of the inner tub 23. The water is, thereafter, discharged from the outer tub 21 into the outside of the housing 10 through the drain pipe 28.

However, the above washing machine is problematic in that the tub assembly 20 is always vertically held in the housing 10 while being suspended by the hangers 30. Such a vertical position of the tub assembly 20 forces insufficiently tall users to stand on their toes while putting or taking laundry into or out of the tub assemblies 20 in the case of large-scaled washing machines. This is inconvenient to such users.

In addition, the vertically positioned tub assembly 20 is also designed to be repeatedly rotated in opposite directions during a washing operation of a machine. When a secondary water current, formed by the pulsator 25, moves from the pulsator 25 to the upper portion of the assembly 20, the secondary water current fails to effectively move along the sidewall of the tub assembly 20, but moves to a position around the central axis of the tub assembly 20. This regrettably causes the laundry to be entangled together during a washing operation. Another problem experienced in the typical washing machines resides in that the secondary water current fails to have a complex and active flow, but has a simple and weak flow. Such a simple and weak flow of the secondary water current is not suitable for uniformly washing the laundry. This reduces the washing effect of the washing machines.

SUMMARY OF THE INVENTION

Accordingly, the present invention has been made keeping in mind the above problems occurring in the prior art, and an object of the present invention is to provide a washing machine, of which the tub assembly is tilted at a predetermined angle suitable for improving washing effect of the washing machine and being convenient to users while putting or taking laundry into or out of the tub assembly.

In order to accomplish the above object, the present invention provides a washing machine, comprising: an upright housing, a washing tub assembly installed inside the housing, and a tub holding means for elastically holding the tub assembly inside the housing while stably tilting the tub assembly at a predetermined angle relative to the perpendicular of the housing.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
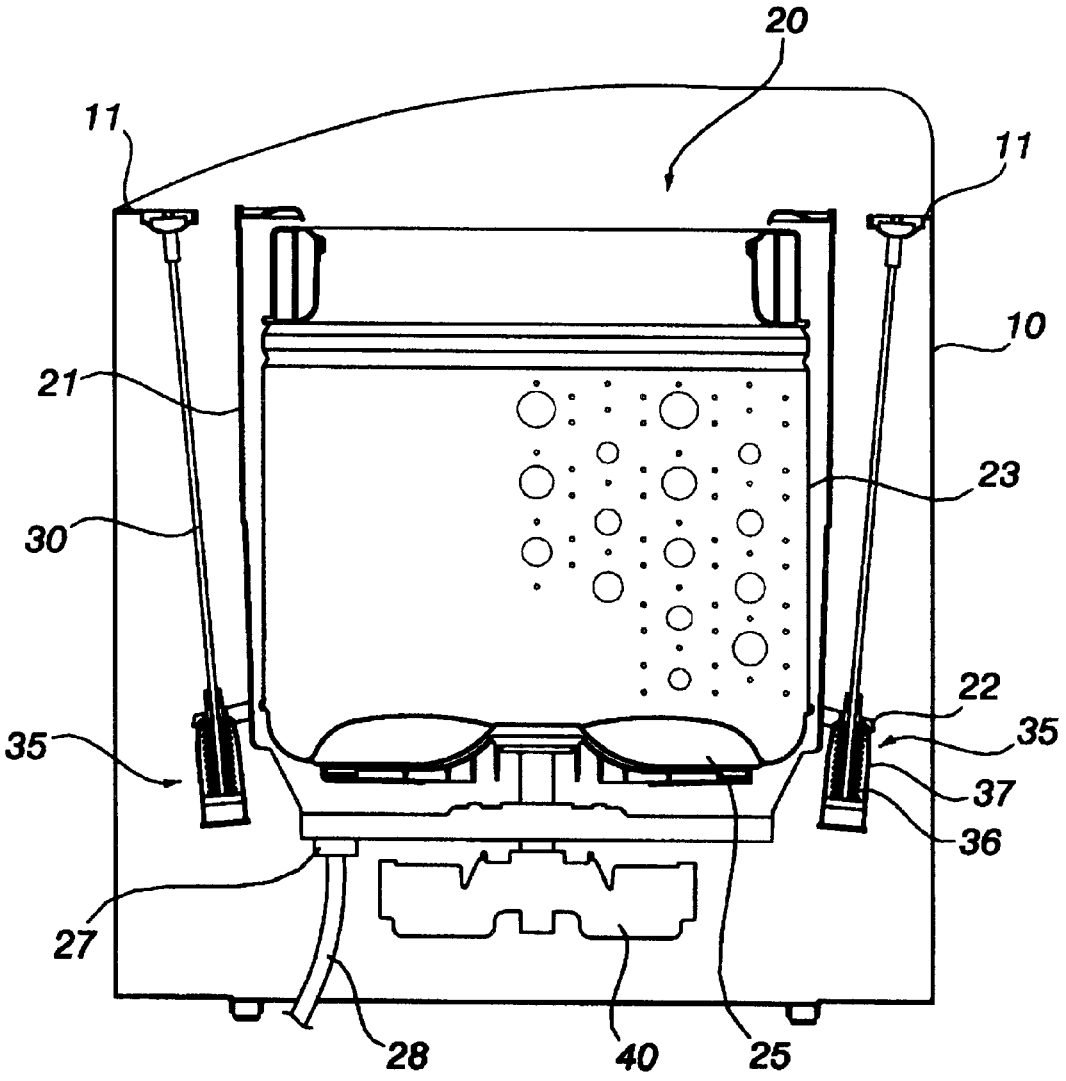
Fig.1(Prior Art)
FIG. 1 is a side sectional view, showing the construction of a typical washing machine.
Figure 2:
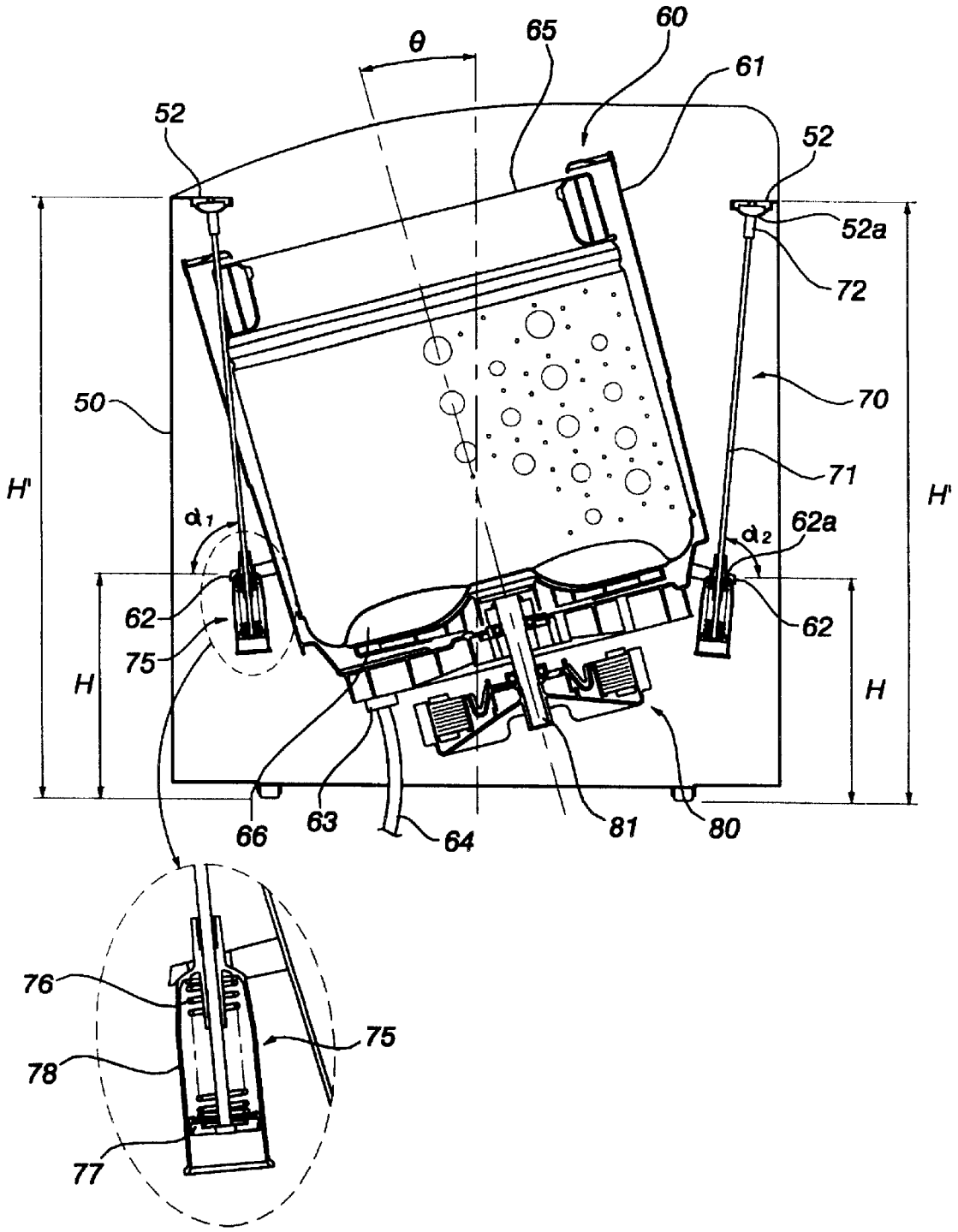
FIG. 2 is a side sectional view, showing the construction of a washing machine with a tilted tub assembly in accordance with the primary embodiment of the present invention.

FIG. 2 is a side sectional view, showing the construction of a washing machine with a tilted tub assembly in accordance with the primary embodiment of the present invention. As shown in the drawing, the washing machine according to the primary embodiment of this invention comprises a housing 50 and a washing tub assembly 60. The washing tub assembly 60 is installed inside the housing 50 while being tilted at an angle of θ relative to the perpendicular of the housing 50, and has a perforated inner tub 65 performing a washing operation. Four damper hangers 70 support the tilted tub assembly 60 in the housing 50 while suspending and tilting the assembly 60 in said housing 50 and performing a damper function. The four hangers 70 thus form a tub holding means. The above hangers 70 are coupled to the upper portion of the housing 50 at their top ends and to the lower portion of the tub assembly 60 at their lower ends. The washing machine also has a drive motor 80, which is provided under the tub assembly 60 and rotates the inner tub 65 of the tub assembly 60.

The tub assembly 60 comprises two tubs: an outer tub 61 and an inner tub 65. The outer tub 21 is held by the hangers 70 inside the housing 50 while being tilted at an angle. On the other hand, the inner tub 65, densely perforated on its sidewall, is concentrically positioned inside the outer tub 61 with a pulsator 66 being interiorly integrated with the bottom of the inner tub 65. The above pulsator 66 is for improving washing effect of the washing machine. The inner tub 65 is coupled to a drive motor 80, thus being rotatable in conjunction with the drive motor 80.

As described above, the tub assembly 60, comprising the outer and inner tubs 61 and 65, is tilted at an angle of e relative to the perpendicular of the housing 50. In the preferred embodiments of this invention, the angle of θ is set to $\theta°<\theta<30°$.

Figure 3:
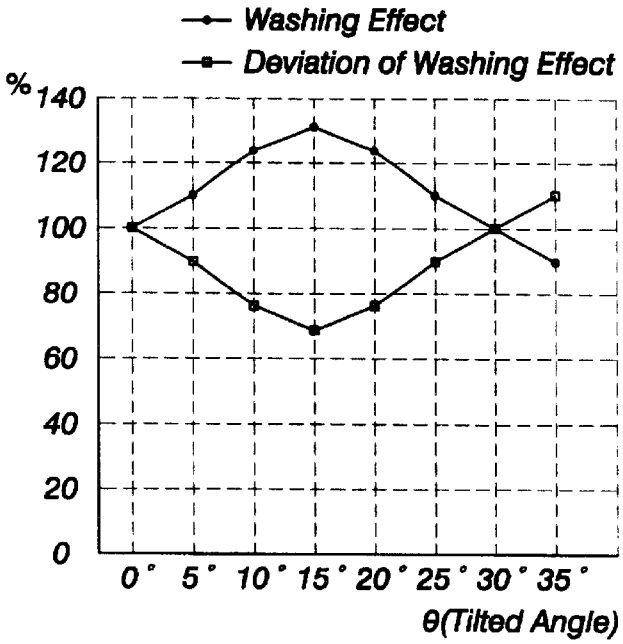
FIG. 3 is a graph, showing both the washing effect and the washing effect deviation of the tilted tub assembly of this invention in accordance with tilted angles of the assembly.

As shown in the graph of FIG. 3, both the washing effect and the deviation of the washing effect of the washing machine vary in accordance with the angles of the tilted tub assembly. That is, the graph shows that when the tilted angle (θ) is set to about 15°, the washing effect of the washing machine is maximized, while the deviation of the washing effect is minimized. In such a case, the term "deviation of washing effect" means a nonuniformity of washing effect after a washing operation. Therefore, the deviation value is in inverse proportion to the washing effect.

Both the improvement in the washing effect and the reduction in the deviation of the washing effect, expected from the tilted tub assembly 60 of this invention, is resulted from a complex and active flow of water currents within the tub assembly 60. That is, when the inner tub 65 of the tilted tub assembly 60 is rotated at an appropriate speed, primary and secondary water currents actively whirl within the tub assembly 60 while actively flowing upwardly and downwardly. This allows a mechanical action of the water currents to more effectively act on the laundry, thus resulting in a desired washing effect without allowing the laundry to be entangled together.

Figure 4:
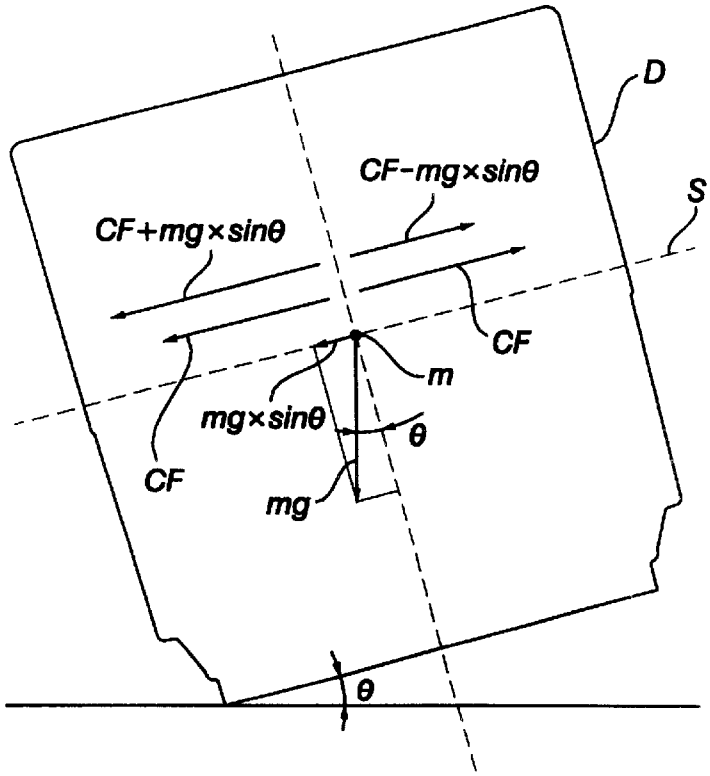
FIG. 4 is a view, showing both a centrifugal force and a gravity force commonly acting on a material point within the tilted tub assembly of this invention.

Such an operational effect of the tilted tub assembly 60 is shown in FIG. 4 in detail. The drawing, FIG. 4, shows a distribution of forces acting on a material point "m" within a tub assembly "D" tilted at an angle of θ. The gravity force "mg" acts on the point "m" in a perpendicular direction, while a centrifugal force "CF" acts on the point "m" in a direction parallel to the inclined surface "S" due to a rotating action of the pulsator or an inner tub of the tub assembly "D". The force, acting on the point "m" in a downward direction along the downward portion of the inclined surface "S", is $CF+(mg\times\sin\theta)$. That is, the sum of the centrifugal force "CF" and a component force $(mg\times\sin\theta)$ of the gravity force "mg" acts on the point "m" in said downward direction along the surface "S". On the other hand, the force, acting on the point "m" in an upward direction along the upward portion of the inclined surface "S", is CF−(mg×sin θ). That is, subtraction of the component force (mg×sin θ) of the gravity force "mg" from the centrifugal force "CF" acts on the point "m" in said upward direction along the surface "S".

The forces, acting on a material point "m" of a tilted tub assembly "D", are asymmetric, thus resulting in a complex and active flow of water currents within the tilted tub assembly "D" different from a typical tub assembly which is vertically positioned in an upright housing. Therefore, such a tilted tub assembly "D" improves the washing effect while reducing the deviation of washing effect.

However, when the tilted angle (θ) of the tub assembly "D" exceeds the largest limit of the predetermined range, the tub assembly "D" is mainly influenced by the gravity force "mg" rather than the centrifugal force "CF". This makes the tilted tub assembly to be unbalanced more and more, and so the tub assembly fails to be smoothly rotated, but overloads the drive motor. In such a case, the laundry also fails to actively move along the sidewall of the tub assembly "D". Therefore, the laundry is neither uniformly spread on the sidewall of the assembly "D" nor effectively washed, but is entangled together at the central portion of the tub assembly "D". When the laundry is entangled together within the tub assembly as described above, it is almost impossible for the dirt of the laundry to effectively be removed. This results in a reduction in the washing effect and an increase in the deviation of the washing effect.

It is, thus, preferable to appropriately tilt the tub assembly 60 at an angle of θ (θ°<θ<30°) as shown in FIG. 3. The tilted angle (θ) may be appropriately changed within the limited range in accordance with both washing conditions and the structure of a washing machine used with the tilted tub assembly 60. In accordance with experimental results, the washing effect of the tilted tub assembly 60 is maximized when the tub assembly 60 is tilted at an angle of 15°.

In addition, it is more preferable to tilt the tub assembly 60 forward since the forward tilted tub assembly 60 is more convenient to users while putting or taking laundry into or out of the tub assembly 60 or observing the laundry outside a washing machine during a washing operation.

In order to install the tub assembly 60 within the housing 50 while retaining a tilted position of the assembly 60, it is necessary to stably support the tilted tub assembly 60 within the housing 50 without allowing the assembly 60 to undesirably change its tilted position. Such an object is accomplished by the four damper hangers 70. The four damper hangers 70, individually having a longitudinal rod, are interiorly installed at four corners of the housing 50 while being held on housing brackets 52, which are formed on the upper portion of the housing 50, at their top ends. The lower ends of the hangers 70 are individually held on a tub bracket 62, which is formed on the lower portion of the outer tub 61.

As best seen in FIG. 2, it is preferable to form the tub brackets 62 on the external surface of the outer tub 61 at different positions so as to allow the brackets 62 to be positioned at the same height (H) from a support surface when the outer tub 61 is tilted at an angle of θ. That is, two tub brackets 62, provided at the front portion of the outer tub 61, are preferably positioned remote from the bottom of the outer tub 61, while the other two brackets 62, provided at the rear portion of the outer tub 61, are positioned close to the bottom of said tub 61.

In addition, the housing brackets 52 are preferably formed on the interior surface of the housing 50 at the same height (H') from the support surface. However, it should be understood that two housing brackets 52, provided at the rear portion of the housing 50, may be positioned higher than the other two housing brackets 52, provided at the front portion of the housing 50, in accordance with a tilted angle of the tub assembly 60.

As described above, four housing brackets 52 are interiorly mounted to the housing 50, while four tub brackets 62 are exteriorly mounted to the outer tub 61. Each of the brackets 52 and 62 individually have a hole 52*a*, 62*a* at the center, thus holding an associated damper hanger 70.

Each of the damper hangers 70 comprises a longitudinal rod 71. A top locking flange member 72 is fixed to the top end of the rod 71, thus being caught by the housing bracket 52. The lower ends of the hangers 70 are individually provided with a damper unit 75 for elastically suspending and supporting the tilted tub assembly 60 within the housing 50.

It is preferable to set the four hangers 70 while allowing each of the rods 71 of said hangers 70 to be inclined at an angle of α relative to a horizontal surface. When the inclination angles α of the rods 71 relative to the horizontal surface are different from each other, the forces acting on the damper units 75 may be different from each other due to weight of the laundry in the tub assembly 60. This causes an abnormal vibration of the tub assembly 60 during a washing operation of the washing machine. In order to overcome such a problem, the four hangers 70 are set in a way such that the inclination angle $\alpha_1$ of the two front rods 71 relative to the horizontal surface is equal to the angle $\alpha_2$ of the two rear rods 71.

When the four hangers 70 are set in the housing 50 while inclining the four rods 71 at the same inclination angle α relative to the horizontal surface, it is possible to reduce the operational vibration and noise of the washing machine.

Each of the damper units 75 comprises a hollow damper case 78, which is held by a tub bracket 62 at its upper portion and receives a coil spring 76. The lower end of the longitudinal rod 71, having a flanged stopper 77, is axially inserted into the damper case 78, with the spring 76 being fitted over the lower end of the rod 71 and being stopped by the stopper 77 so as to be retained within the case 78. The damper units 75 thus elastically suspend the tilted tub assembly 60 within the housing 50.

In the present invention, the drive motor 80 used for rotating the tilted tub assembly 60, may be directly coupled to the inner tub 65 of the assembly 60 or indirectly coupled to the inner tub 65 through a clutch unit. However, it is necessary for the drive motor 80 to be set under the outer tub 61 of the assembly 60 while being inclined at the same angle as the tilted angle of the tub assembly 60. In addition, the output shaft 81 of the motor 80 passes through the bottom of the outer tub 61 prior to being coupled to the bottom of the inner tub 65 while being inclined at an angle of θ relative to the perpendicular of the housing 50. The inner tub 65 is thus rotatable by the rotational force of the drive motor 80.

A drain port 63 is formed on the bottom of the outer tub 61 of the tilted tub assembly 60 at a lower position with a drain pipe 64 extending from the drain port 63 into the outside of the housing 50. Of course, a drain valve (not shown) is provided on either the drain port 63 or the drain pipe 64.

The operational effect of the washing machine according to the primary embodiment of this invention will be described hereinbelow.

Laundry, such as clothes, sheets, etc., is put into the perforated inner tub 61 of the tilted tub assembly 60 prior to starting the washing machine. When the machine is started, water is supplied from a pipe line into the tub assembly 60 until the water reaches a predetermined level. In such a case, since the tub assembly 60 is tilted down in a forward direction at an angle, the water in the assembly 60 leans forward with the water surface forming a horizontality while being parallel to a support surface. Of course, the water level is determined in accordance with the volume of laundry.

Thereafter, the drive motor 80 is started, thus outputting a rotating force to the inner tub 65, integrated with the pulsator 66, through the output shaft 81. Therefore, the inner tub 65 along with the pulsator 66 is rotated. This forms complex and active water currents suitable for effectively washing the laundry in the assembly 60. That is, a washing process is started.

When the inner tub 65 along with the pulsator 66 is rotated as described above, a primary water current, caused by a centrifugal force, moves upwardly along the sidewall of the inner tub 65. Since the inner tub 65 is tilted at an angle relative to the perpendicular of the housing 50, with a gravity force downwardly acting along said perpendicular, the primary water current forms an asymmetric and complex flow due to an interaction between the gravity force, the centrifugal force and the inclined inside wall of the inner tub 65. This results in a complex and active flow of laundry within the inner tub 65.

In addition, the pulsator 66, used for generating a secondary water current within the inner tub 65, is positioned while being inclined at the same angle, a lift force in addition to the centrifugal force acts on the secondary water current. Therefore, the secondary water current forms an asymmetric and complex flow in the same manner as that described for the primary water current.

In a brief description, different from a typical washing machine where the primary and secondary water currents simply and weakly move to a position around the central axis of the vertical tub assembly and regrettably cause laundry to be entangled together, and reduce the washing effect, the tilted tub assembly of this invention makes the primary and second water currents complex and active. Such complex and active water currents, formed in the tilted tub assembly of this invention, effectively prevent the laundry from being entangled together and uniformly act on the laundry, thus preferably improving the washing effect.

Figure 5:
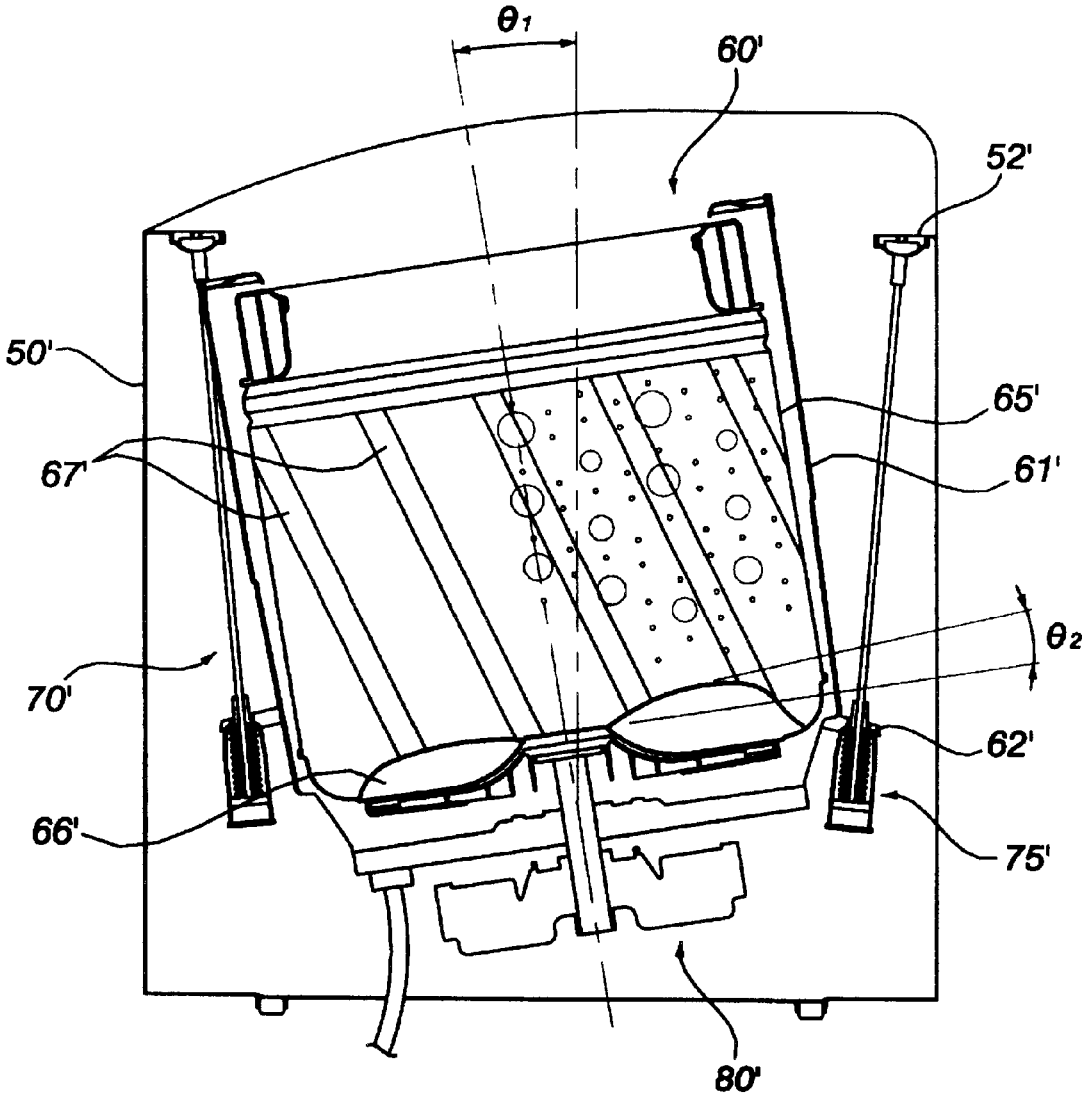
FIG. 5 is a side sectional view, showing the construction of a washing machine with a tilted tub assembly in accordance with the second embodiment of this invention.

FIG. 5 is a side sectional view, showing the construction of a washing machine with a tilted tub assembly in accordance with the second embodiment of this invention.

In the second embodiment, a tub assembly 60', consisting of concentric outer and inner tubs 61' and 65', is supported inside an upright housing 50' by four damper hangers 70' while being tilted at angle of $\theta_1$ relative to the perpendicular of the housing 50' in the same manner as that described for the primary embodiment of the present invention. A drive motor 80' is provided at a position under the tilted tub assembly 60' for rotating the inner tub 65' of the tub assembly 60' during a washing operation of the washing machine.

However, either the bottom wall of the inner tub 65' or the top surface of the pulsator 66' of the second embodiment is designed to be further tilted at an angle of $\theta_2$ relative to the bottom wall of the outer tub 61' different from the primary embodiment. A plurality of laundry guide ribs 67' are formed on the interior surface of the sidewall of the inner tub 65' while being inclined at an angle relative to the central axis of the inner tub 65'. The above guide ribs 67' are for guiding the laundry when the laundry moves upwardly and downwardly along with water currents within the tub 65'.

In the present invention, it is preferable to design the guide ribs 67' to extend from the top edge of the inner tub 65' to the bottom edge while being spaced out at regular intervals and being helically inclined in the same direction as the tilted direction of the tub assembly 60'.

If the tub assembly 60' is designed to be tilted at an angle larger than an appropriate angle, it is necessary to enlarge the volume of the housing 50' with the same capacity of laundry as that expected from the housing 50 of the primary embodiment. In addition, such an exceedingly tilted position of the tub assembly 60' undesirably causes operational vibration and noise during repeated water-drainage processes of a washing operation. The tub assembly 60' of the second embodiment is designed to overcome the above-mentioned problem. That is, the top surface of the pulsator 66', integrated with the bottom wall of the inner tub 65', is further inclined at an angle of $\theta_2$ relative to the bottom wall of the tilted tub assembly 60' as shown in FIG. 5. The tub assembly 60' of the second embodiment thus effectively increases torque while reducing the tilted angle $\theta_1$ of the tub assembly 60, with the torque being necessary to cause an active relative motion of the laundry to the tub assembly 60'. The tub assembly 60' thus further improves the washing effect in comparison with the assembly 60 of the primary embodiment.

The four damper hangers 70', suspending and supporting the tilted tub assembly 60' within the housing 50', individually have a longitudinal rod and are interiorly installed at four corners of the housing 50'. That is, the top ends of the four hangers 70' are held on four housing brackets 52' interiorly formed on the upper portion of the housing 50'. On the other hand, the lower ends of the hangers 70' are individually held on a tub bracket 62', which is exteriorly formed on the lower portion of the outer tub 61'.

Of course, the lower end of each hanger 70' is elastically held by a damper unit 75' caught by a tub bracket 62'. The damper unit 75' is for absorbing external shock, acting on the hanger 70' during a washing operation, and has the same construction as that of the damper unit 75 of the primary embodiment, and further explanation is thus not deemed necessary.

The washing machine of the second embodiment is operated as follows.

When the inner tub 65' along with the pulsator 66' is rotated by the rotating force of the drive motor 80', a primary water current, caused by a centrifugal force, actively moves upwardly along the sidewall of the inner tub 65' of the tilted assembly 60'. In such a case, the inner tub 65' is tilted at an angle relative to the perpendicular of the housing 50' with a gravity force downwardly acting along said perpendicular, and so the tub 65' allows the primary water current to form an asymmetric and complex flow due to an interaction between the gravity force, the centrifugal force and the inclined inside wall of the inner tub 65'. This results in a complex and active flow of laundry within the inner tub 65'.

In addition, since the pulsator 66', forming a secondary water current within the inner tub 65', is positioned while being further inclined at an angle relative to the bottom wall of the tilted tub assembly 60', a lift force in addition to the centrifugal force actively acts on the secondary water current. Therefore, the secondary water current forms an asymmetric and complex flow.

When the laundry moves upwardly and downwardly along the sidewall of the tilted inner tub 65' due to the centrifugal force, the laundry more smoothly moves under the guide of the guide ribs 67' formed on the inner tub 65'.

In a brief description, the washing machine according to the second embodiment has an inner tub 65' tilted at an angle relative to the perpendicular of an upright housing 50' with either the bottom wall of the tub 65' or the top surface of a pulsator 66' being further inclined relative to the bottom wall of a tilted tub assembly 60'. Therefore, the second embodiment more improves the washing effect while reducing the tilted angle of the tub assembly.

Figure 6:
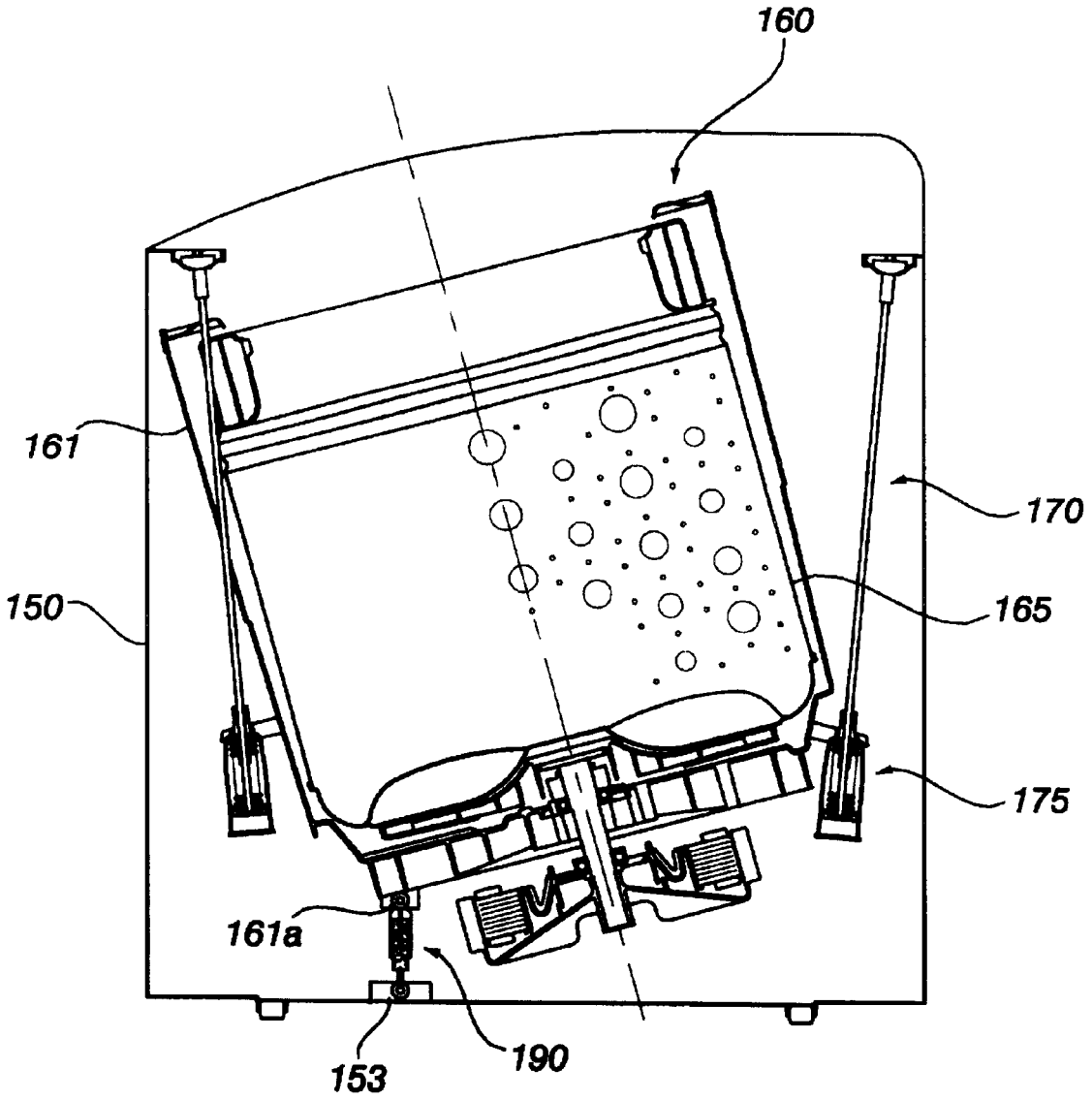
FIG. 6 is a side sectional view, showing the construction of a washing machine with a tilted tub assembly in accordance with the third embodiment of this invention.

FIG. 6 is a side sectional view, showing the construction of a washing machine with a tilted tub assembly in accordance with the third embodiment of this invention.

In the third embodiment, the general shape of the washing machine remains the same as that described for the primary embodiment, but a shock absorbing unit 190 is set between the bottom wall of the outer tub 161 of the tilted tub assembly 160 and the bottom wall the upright housing 150. The above unit 190 is for supporting the bottom of the assembly 160 while absorbing both the natural vibration of the assembly 160 and the impacts undesirably applied to the assembly 160. The unit 190 may be thus so-called a tub support unit.

That is, since the tub assembly 160 is tilted at an angle relative to the perpendicular of the housing 150, the inner tub 165 may generate upsetting vibration and noise during a rotating action. The shock absorbing unit 190 of the third embodiment is for reducing such vibration and noise and elastically supporting the tub assembly 160. A shock absorber or a spring may be preferably used as the unit 190.

In the embodiment of FIG. 6, the unit 190 comprises a shock absorber of the conventional pneumatic or hydraulic type. The above shock absorber 190 supports the tub assembly 160 while absorbing the natural vibration of the assembly 160 during a rotating action of the inner tub 165. This accomplishes a stable and effective washing operation of the washing machine.

Of course, a coil spring in place of the shock absorber may be preferably used as the unit 190. In such a case, the spring may effectively absorb the natural vertical vibration of the tub assembly 160.

The top end of the shock absorber 190 is mounted to an upper bracket 161*a* formed on the bottom wall of the outer tub 161, while the lower end is mounted to a lower bracket 153 formed on the bottom wall of the housing 150.

Figure 7:
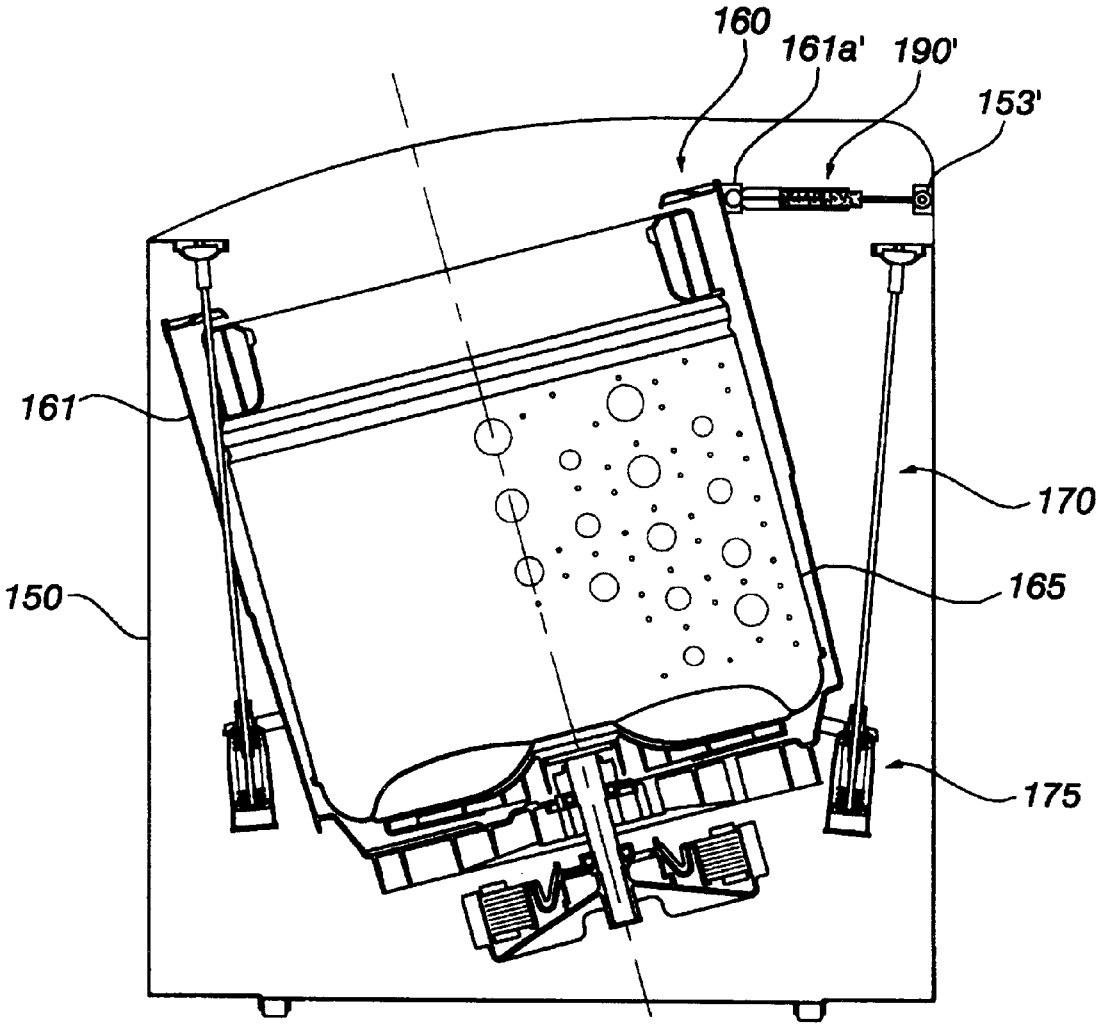
FIG. 7 is a side sectional view, showing the construction of a washing machine with a tilted tub assembly in accordance with the fourth embodiment of this invention.

FIG. 7 is a side sectional view, showing the construction of a washing machine with a tilted tub assembly in accordance with the fourth embodiment of this invention.

In the fourth embodiment, the general shape of the washing machine remains the same as that described for the third embodiment, but the shock absorbing unit 190' is set between the rear wall of the outer tub 161 of the tilted tub assembly 160 and the rear wall of the upright housing 150 different from the unit 190 of the third embodiment, with the unit 190 being set between the bottom wall of the outer tub 161 and the bottom wall of the housing 150.

That is, one end of the shock absorbing unit 190' of the fourth embodiment is held on the top edge of the rear wall of the tub assembly 160 which is tilted downwardly in a forward direction. The other end of the means 190' is held on the rear wall of the housing 150. The shock absorbing unit 190' thus stably supports the tilted position of the tub assembly 160 while absorbing the natural vibration of the assembly 160 during a rotating action of the inner tub 165.

In the same manner as that described for the third embodiment, a conventional shock absorber or a conventional spring may be preferably used as the shock absorbing unit 190' of the fourth embodiment. In order to hold both ends of the shock absorbing unit 190', a bracket 153' is interiorly formed at the rear wall of the housing 150, with another bracket 161*a'* being exteriorly formed at the rear wall of the outer tub 161.

Figure 8:
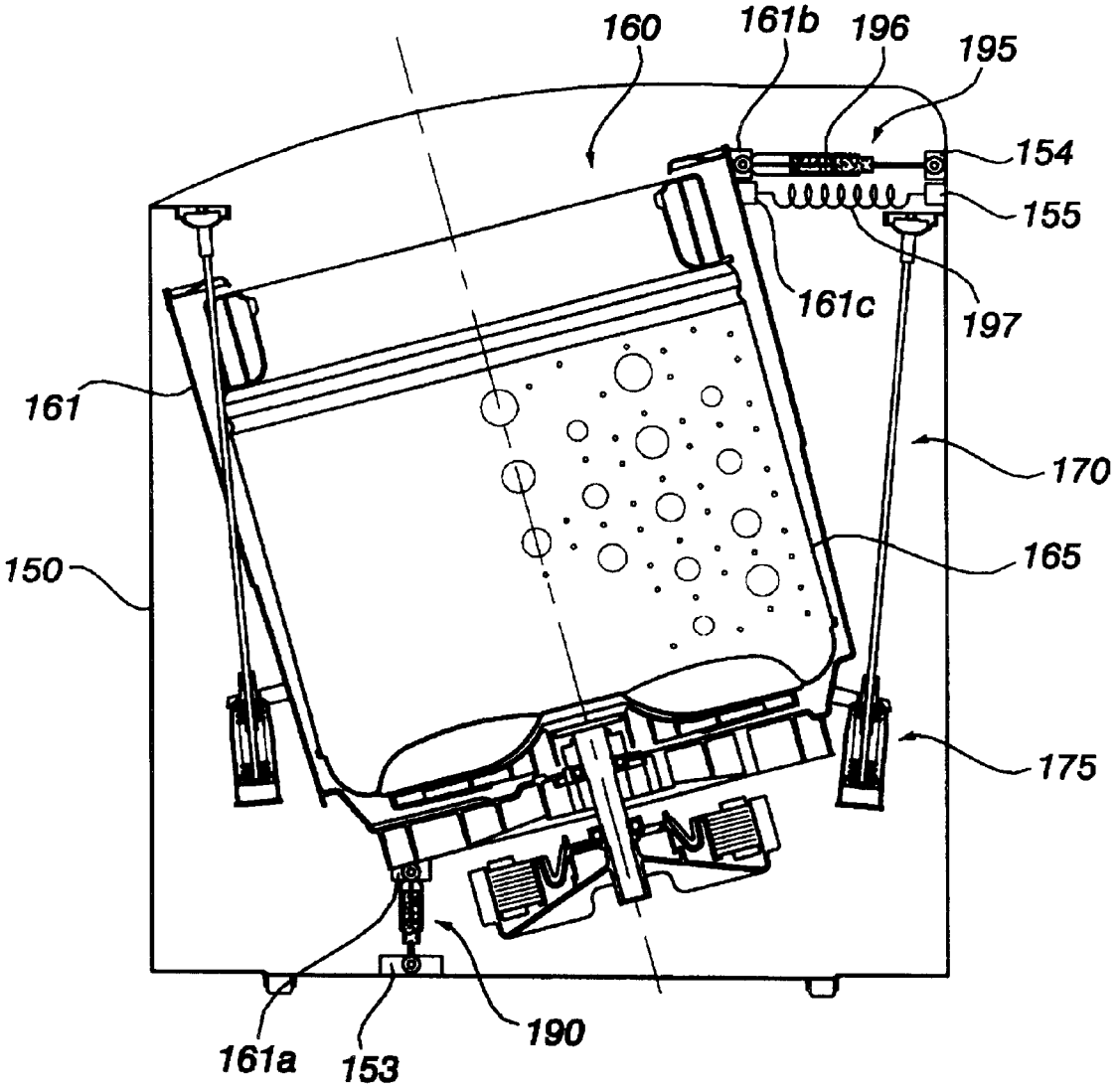
FIG. 8 is a side sectional view, showing the construction of a washing machine with a tilted tub assembly in accordance with the fifth embodiment of this invention.

FIG. 8 is a side sectional view, showing the construction of a washing machine with a tilted tub assembly in accordance with the fifth embodiment of this invention.

The fifth embodiment is combination of the abovementioned third and fourth embodiments, thus being for holding the tilted tub assembly 160 at two positions. That is, the tilted assembly 160 of the fifth embodiment is held by a first shock absorbing unit 190 at the bottom wall of the outer tub 161 and is held by a second shock absorbing unit 195 at the rear wall of the tub 161.

In the fifth embodiment, the first shock absorbing unit 190 comprises one shock absorber, while the second shock absorbing unit 195 comprises one tension coil spring 197 in addition to one shock absorber 196. The two shock absorbing units 190 and 195 support the tilted position of the tub assembly 160 at two positions, thus more effectively reducing the operational vibration and noise of the washing machine.

In order to mount the two shock absorbing units 190 and 195 in the washing machine, the outer tub 161 has a plurality of tub brackets 161*a*, 161*b* and 161*c*, with a plurality of housing brackets 153, 154 and 155 being formed on the housing 150.

In the third to fifth embodiments, the tilted position of the tub assembly 160 within the upright housing 150 is supported by at least one shock absorbing unit 190, 190', 195 in addition to the four damper hangers 170. Therefore, the washing machine according to any one of the third to fifth embodiments further reduces the operational vibration and noise in comparison with the washing machine of the primary and second embodiment individually only having four damper hangers.

Figure 9:
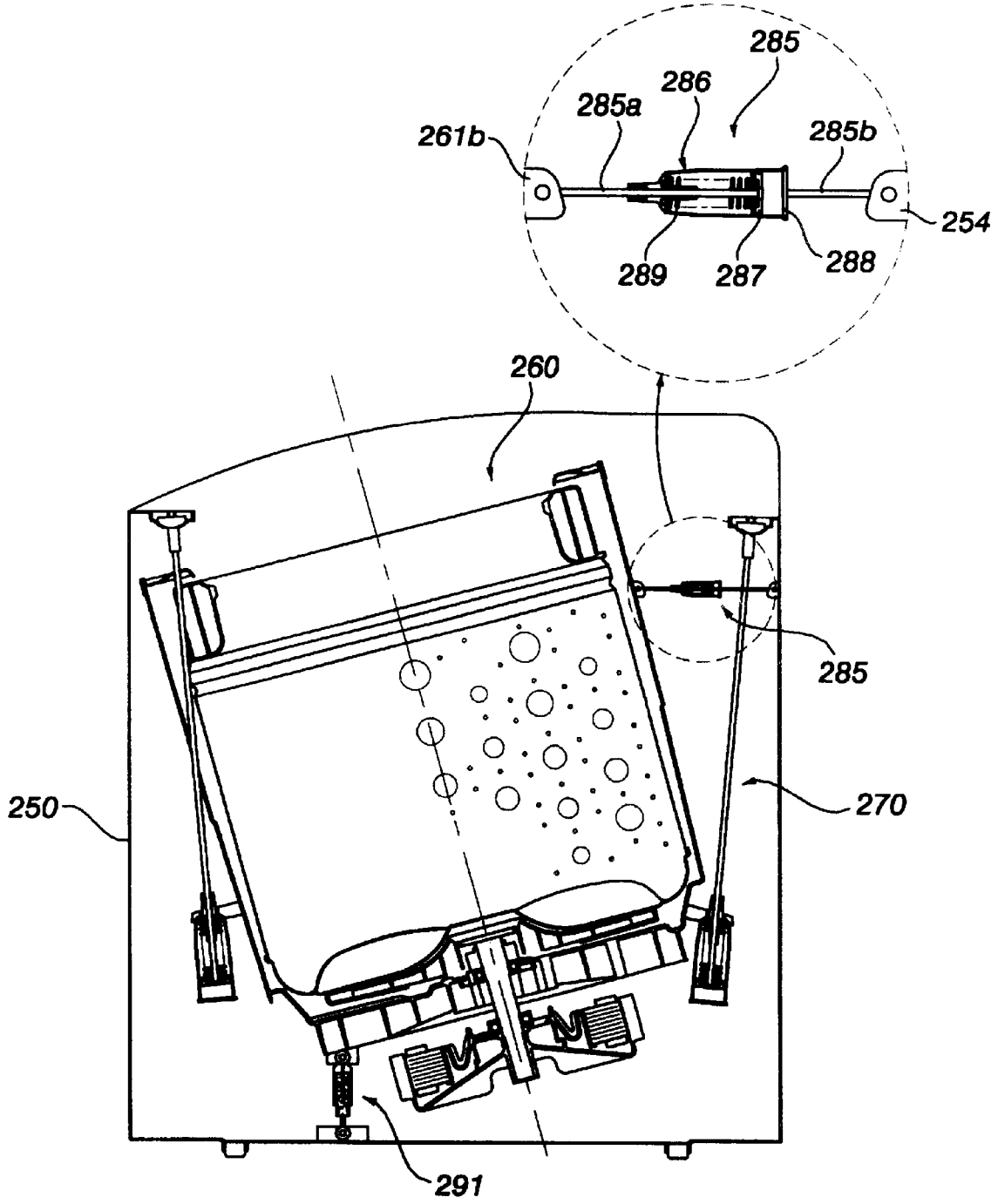
FIG. 9 is a side sectional view, showing the construction of a washing machine with a tilted tub assembly in accordance with the sixth embodiment of this invention.

FIG. 9 is a side sectional view, showing the construction of a washing machine with a tilted tub assembly in accordance with the sixth embodiment of this invention.

Different from the primary to fifth embodiments wherein the washing machine is designed to allow the tilted angle of the tub assembly to be adjusted by changing the position of the brackets or by changing the length of the damper hangers, the washing machine according to the sixth embodiment is designed to allow the tilted angle of the tub assembly to be adjusted and held by a tub tilting buckle 285 coupled to both the housing 250 and the tub assembly 260. The above tilting buckle 285, having a longitudinal rod shape, pushes or pulls the upper portion of the rear wall of the tilted tub assembly 260, thus holding the tilted position of the assembly 260.

As shown in FIG. 9, one end of the buckle 285 is mounted to the rear wall of the tub assembly 260, while the other end of the buckle 285 is mounted to the upright housing 250, with the tub assembly 260 being tilted downwardly in a forward direction at an angle relative to the perpendicular of the housing 250 and being suspended within the housing by four damper hangers 270. In such a case, the tub tilting buckle 285 pushes or pulls the upper portion of the tilted tub assembly 260, thus more effectively holding the tilted position of the assembly 260.

The above tilting buckle 285 may comprise one longitudinal tilting rod with both ends of the rod being respectively mounted to two brackets 261*b* and 254, respectively provided on the tub assembly 260 and the housing 250.

Alternatively, the tub tilting buckle 285 may be provided with a damper unit 286 at the middle portion as shown in FIG. 9. In such a case, it is possible for the tilting buckle 285 to have a damper function in addition to a tub holding function.

When the tub tilting buckle 285 has a damper unit 286 at the middle portion, the buckle 285 comprises two tilting rods 285*a* and 285*b* respectively mounted to the tub assembly 260 and the housing 250. The two rods 285*a* and 285*b* are coupled together by the damper unit 286. That is, the first rod 285*a*, coupled to the tub assembly 260, has a flanged stopper 287 at the outside end and is inserted into a hollow damper case 288 of the damper unit 286 with the stopper 287 being positioned within the case 288. On the other hand, the second rod 285*b*, coupled to the housing 250, is fixed to the case 288 at the outside end thereof. A biasing member or a coil spring 289 is positioned within the case 288 while being fitted over the first rod 285*a* and being stopped by the stopper 287. Due to the biasing member 289, the buckle 285 performs a damper function in addition to a tub holding function.

It is preferable to make the biasing member 289 using a material having a high elastic strength suitable for effectively supporting the tilted position of the tub assembly 260 without failure.

In the same manner as that described above, the tilted position of the tub assembly 260 is primarily held by four damper hangers 270, individually mounted to the housing 250 at the upper end and to the tub assembly 260 at the lower end. It should be understood that both the length of each damper hanger 270 and the position of each bracket for the hanger 270 may be changed in accordance with a desired tilted angle and/or designing conditions of the tub assembly 260.

It is also preferable to provide a shock absorbing unit 291 at a position under the bottom of the tub assembly 260, thus relieving both the operational vibration of the assembly 260 and an impact applied to the assembly during a washing operation.

In the washing machine according to the sixth embodiment, the tub assembly 260 is tilted at an angle relative to the perpendicular of the upright housing, thus forming complex and active water currents. This improves the washing effect while reducing the deviation of the washing effect.

Figure 10:
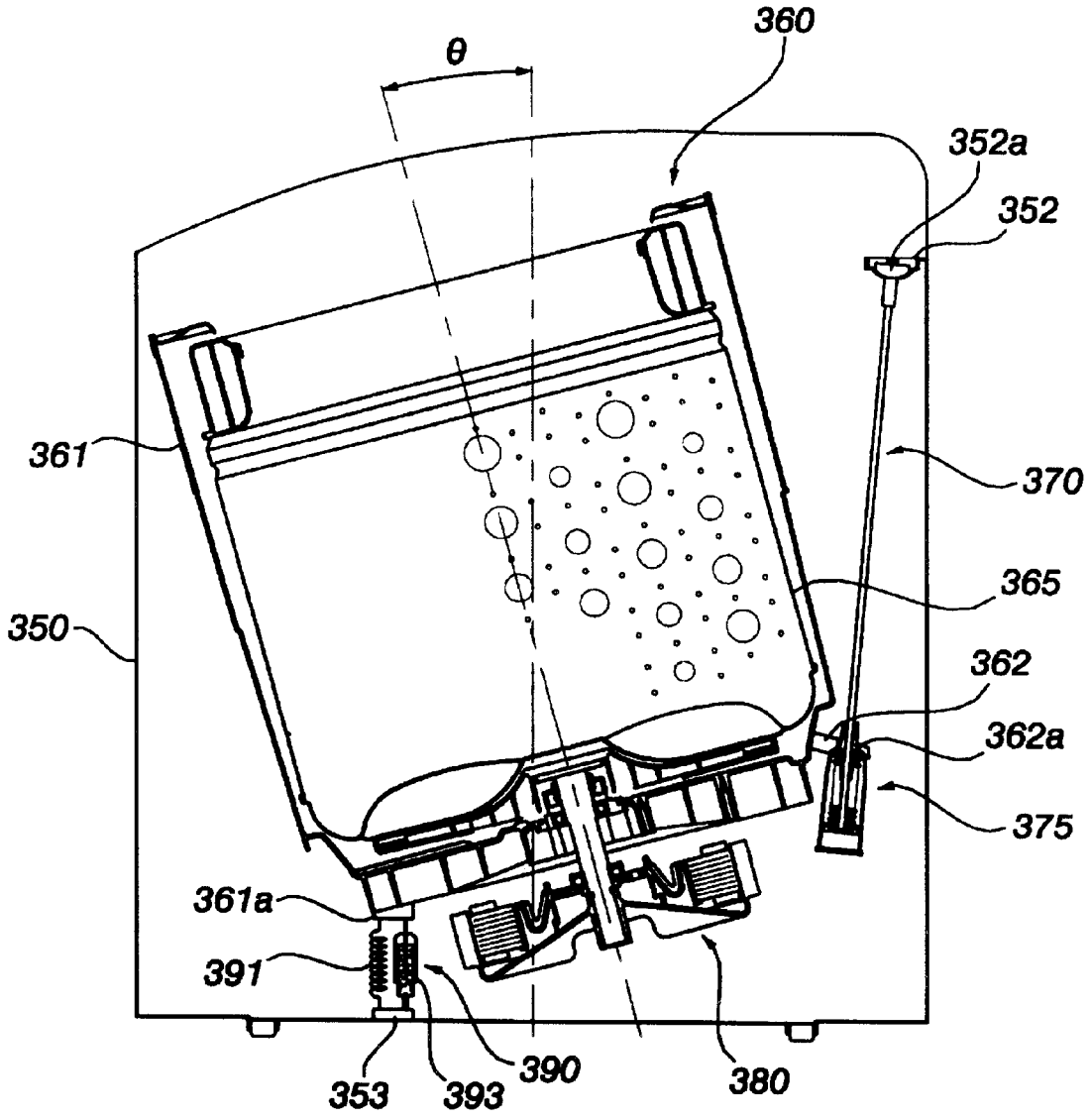
FIG. 10 is a side sectional view, showing the construction of a washing machine with a tilted tub assembly in accordance with the seventh embodiment of this invention.

FIG. 10 is a side sectional view, showing the construction of a washing machine with a tilted tub assembly in accordance with the seventh embodiment of this invention.

In the washing machine of the seventh embodiment, a tub assembly 360, comprising outer and inner tubs 361 and 365, is set within an upright housing 350 while being tilted at an angle of θ relative to the perpendicular of the housing 350. In such a case, the rear portion of the assembly 360 is coupled to the housing 350 by two damper hangers 370. On the other hand, the front portion of the assembly 360 is free from such a damper hanger 370, but is supported on the bottom wall of the housing 350 by an elastic tub support unit 390. The above unit 390 is set between the bottom wall of the assembly 360 and the bottom wall of the housing 350.

That is, the tub assembly 360 is suspended and supported within the upright housing 350 by both the damper hangers 370 and the tub support unit 390 while being tilted at an angle of e relative to the perpendicular of the housing 350.

A drive motor 380 is installed at a position under the tub assembly 360 so as to rotate the inner tub 365 of the assembly 360.

In the same manner as that described for the primary embodiment, the two damper hangers 370 individually have a longitudinal rod and are interiorly installed at two rear corners of the housing 350. The top end of each hanger 370 is held on a housing bracket 352 interiorly formed on the upper portion of the housing 350, while the lower end is held on a tub bracket 362 exteriorly formed on the lower portion of the outer tub 361.

Each of the four brackets 352 and 362 has a hole 352*a*, 362*a* at the central portion, thus holding the damper hanger 370.

Each damper hanger 370 may have a damper unit 375 at the lower end so as to have a damper function in addition to the tub holding function.

The above support unit 390 comprises one spring 391 and one shock absorber 393, which are installed in parallel to each other at a position between the bottom wall of the outer tub 361 and the bottom wall of the housing 350.

The spring 391 or a coil spring is to bear the heavy weight of the tub assembly 360 since it supports the assembly 360 at the lowest position of the tilted assembly 360. It is thus necessary to make the spring 391 using a material having a high elastic strength suitable for effectively supporting such a heavy weight.

The shock absorber 393 may preferably comprise a conventional shock absorber of the pneumatic or hydraulic type. The above shock absorber 393 supports the tub assembly 360 while absorbing the natural vibration of the assembly 360 during a rotating action of the inner tub 365. This accomplishes a stable and effective washing operation of the washing machine.

Of course, a plurality of brackets 353 and 361*a* are formed on the outer tub 361 and the housing 350 so as to hold the spring 391 and the shock absorber 393.

In the seventh embodiment, it is preferable to provide two support units 390 at the front corners of the bottom wall of the tilted tub assembly 360.

Figure 11:
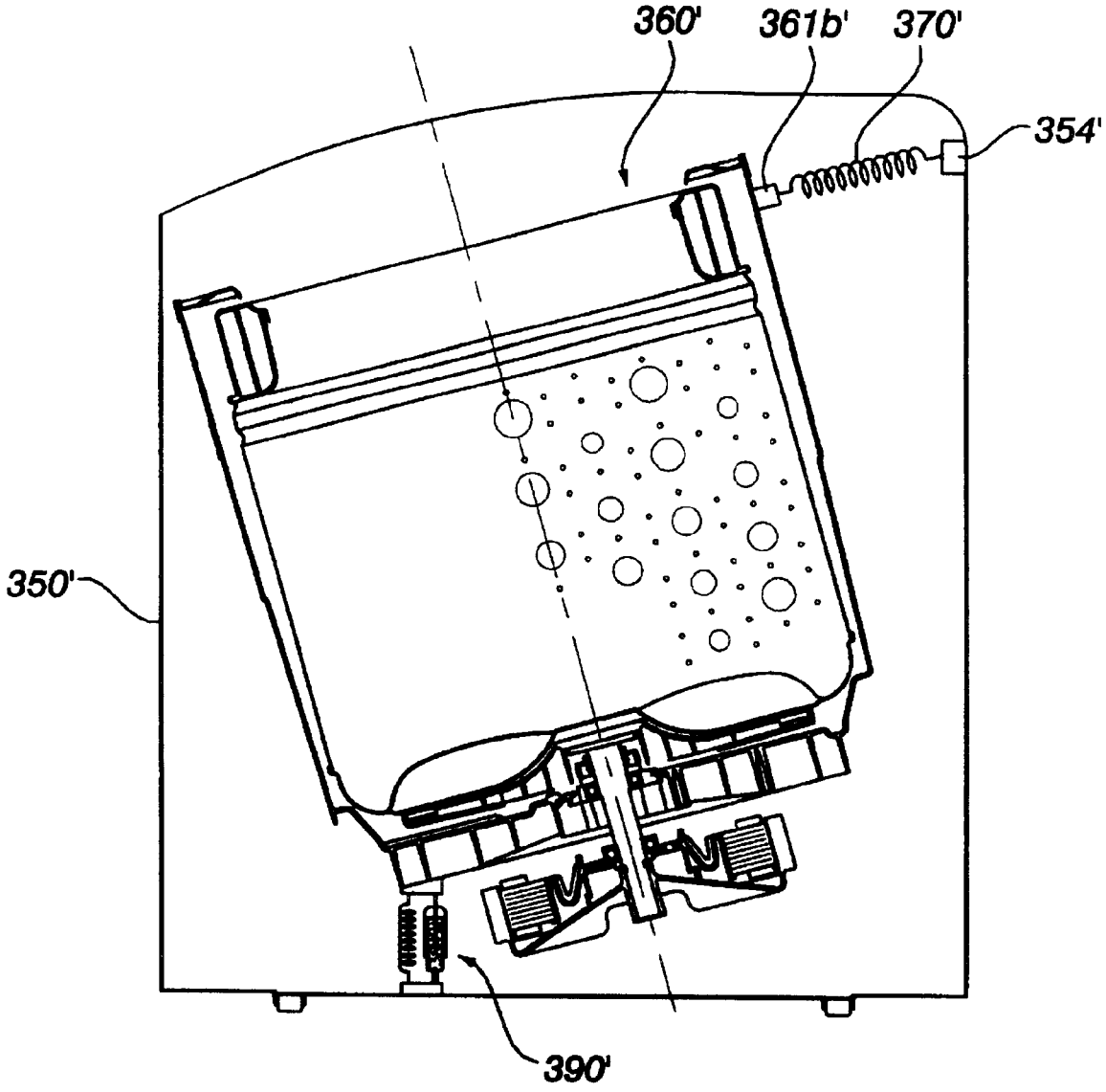
FIG. 11 is a side sectional view, showing the construction of a washing machine with a tilted tub assembly in accordance with the eighth embodiment of this invention.

FIG. 11 is a side sectional view, showing the construction of a washing machine with a tilted tub assembly in accordance with the eighth embodiment of this invention.

Different from the washing machine of the seventh embodiment with the rear portion of the tilted tub assembly 360 being held by the two damper hangers 370, the upper rear portion of the tilted tub assembly 360' according to the eighth embodiment is held by an elastic hanger 370' or a coil spring, which is coupled to the upper rear portion of the assembly 360' and the upper portion of the upright housing 350' at both ends thereof. On the other hand, the bottom wall of the tub assembly 360' is supported on the bottom wall of the housing 350' by an elastic tub support unit 390'.

That is, the tub assembly 360' is suspended and supported within the upright housing 350' by both the elastic hanger 370' and the tub support unit 390', placed at diagonally opposite positions within the housing 350'. In such a case, the assembly 360' is tilted at an angle relative to the perpendicular of the housing 350'.

Of course, a plurality of brackets 354' and 361*b*' are formed on the outer tub 361' and the housing 350' so as to hold the hanger 370'.

In the eighth embodiment, it is preferable to provide two damper hangers 370' at the upper portion of the tilted tub assembly 360' and two tub support units 390' at the lower portion of the of the assembly 360'. The damper hangers 370' and the support units 390' are to bear the heavy weight of the assembly 360', thus being made of a material having a high elastic strength suitable for effectively supporting the tilted heavy assembly 360' during a washing operation.

Figure 12:
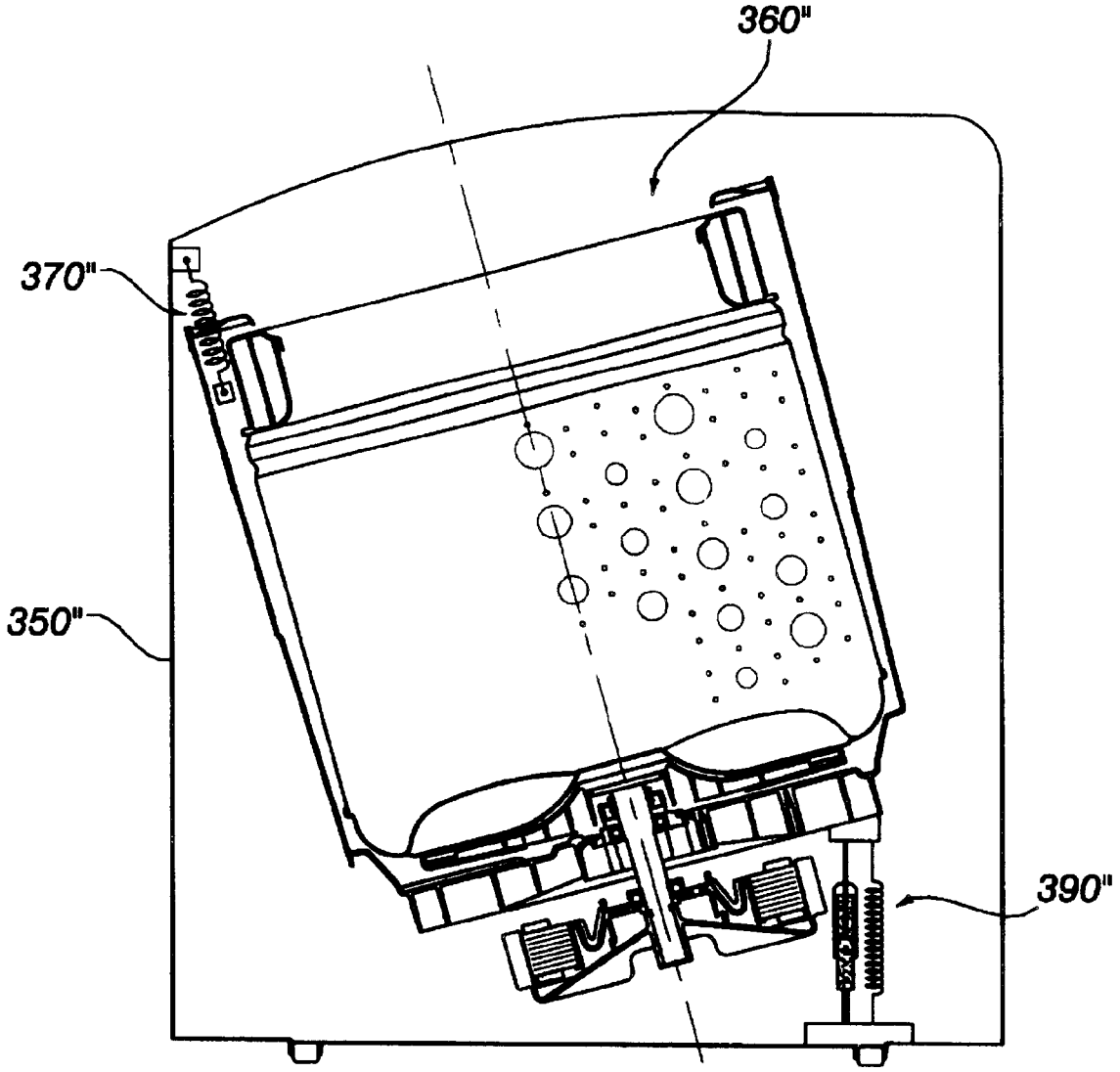
FIG. 12 is a side sectional view, showing the construction of a washing machine with a tilted tub assembly in accordance with the ninth embodiment of this invention.

FIG. 12 is a side sectional view, showing the construction of a washing machine with a tilted tub assembly in accordance with the ninth embodiment of this invention.

In the ninth embodiment, the tilted tub assembly 360" is held by an elastic hanger or a coil spring 370" at the front top portion thereof and by an elastic tub support unit 390" at the rear bottom portion. The above hanger 370", caught by the housing 350" at the top end, elastically suspends the front top portion of the tilted assembly 360", while the support unit 390" biases the rear bottom portion of the assembly 360" upwardly, thus holding the assembly 360" tilted at an angle relative to the perpendicular of the upright housing 350".

In the washing machine according to any one of the seventh to ninth embodiments, the tub assembly 360, 360', 360" is tilted at an angle relative to the perpendicular of an upright housing, thus forming complex and active water currents. This improves the washing effect while reducing the deviation of the washing effect.

Figure 13:
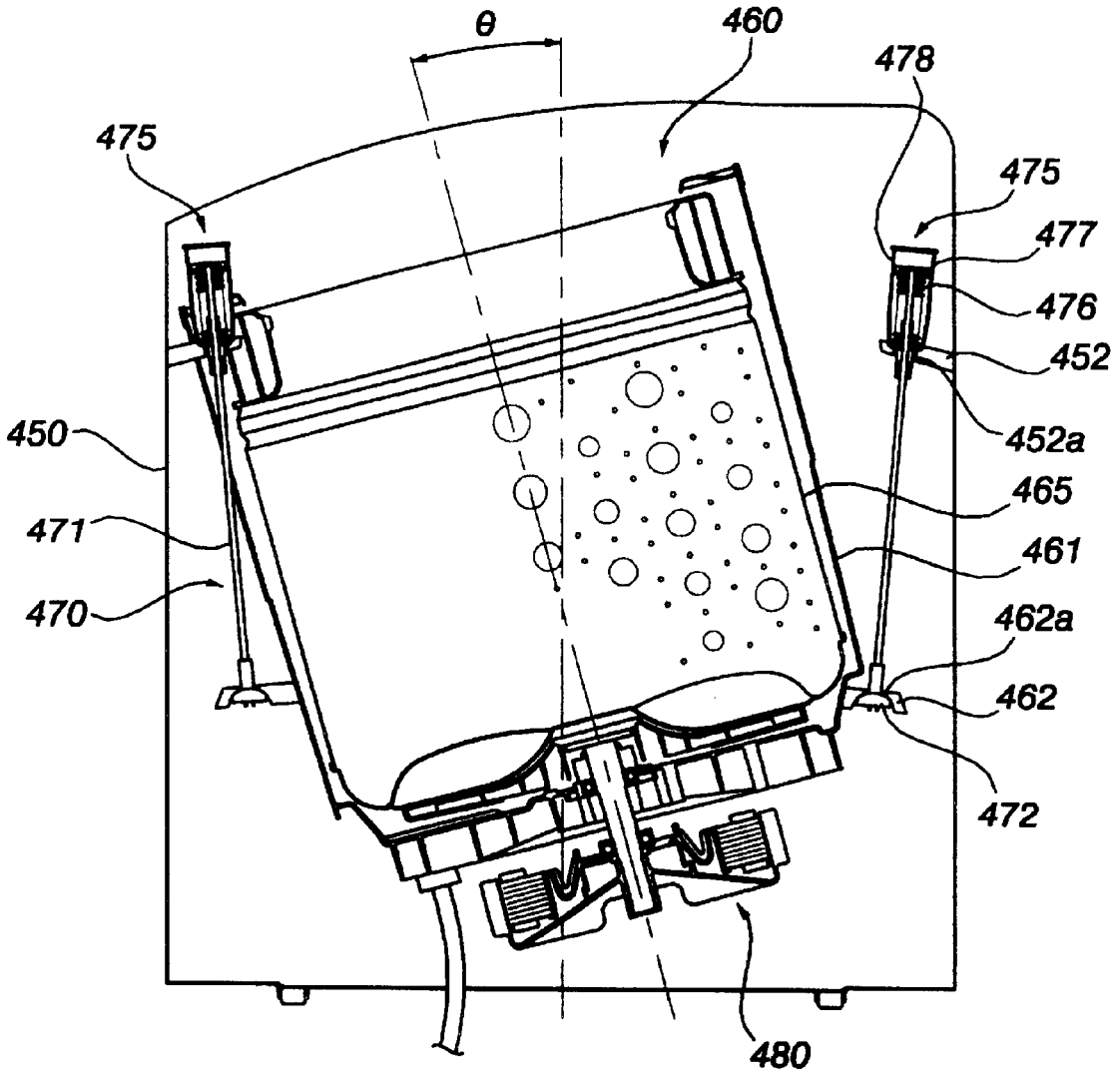
FIG. 13 is a side sectional view, showing the construction of a washing machine with a tilted tub assembly in accordance with the tenth embodiment of this invention.

FIG. 13 is a side sectional view, showing the construction of a washing machine with a tilted tub assembly in accordance with the tenth embodiment of this invention.

In the same manner as that described for the primary embodiment, the tub assembly 460, comprising outer and inner tubs 461 and 465, is suspended and supported within an upright housing 450 by four damper hangers 470 while being tilted at an angle of θ relative to the perpendicular of the housing 450. A drive motor 480 is installed at a position under the tub assembly 460 so as to rotate the inner tub 465 of the assembly 460.

The four damper hangers 470 individually have a longitudinal rod shape and are interiorly installed at four corners of the housing 450. The top end of each hanger 470 is held on a housing bracket 452 interiorly formed on the upper portion of the housing 450, while the lower end is held on a tub bracket 462 exteriorly formed on the lower portion of the outer tub 461.

Each of the damper hangers 470 comprises a longitudinal rod 471. The upper end of each rod 471 is provided with a damper unit 475 for elastically suspending and supporting the tilted tub assembly 460 on the bracket 452 of the housing 450. A locking flange member 472 is fixed to the lower end of the rod 471 and is caught by the bracket 452 of the tub assembly 460.

Each of the damper units 475 comprises a hollow damper case 478, which is caught by a housing bracket 452 and receives a coil spring 476. The upper end of the longitudinal rod 471, having a flanged stopper 477, is axially inserted into the damper case 478, with the spring 476 being fitted over the upper end of the rod 471 and being stopped by the stopper 477 so as to be retained within the case 478. The damper units 475 thus elastically suspend the tilted tub assembly 460 within the housing 450.

In the washing machine of the tenth embodiment, four housing brackets 452 are interiorly mounted to the housing 450, while four tub brackets 462 are exteriorly mounted to the outer tub 461. Each of the brackets 452 and 462 individually have a hole 452*a*, 462*a* at the center, thus holding an associated damper hanger 470.

The operational effect of the washing machine according to the tenth embodiment will be described hereinbelow.

A washing operation of the above washing machine is performed by the tub assembly 460, which is suspended within the upright housing 450 by the four damper hangers 470 while being tilted at an angle relative to the perpendicular of the housing 450 and has one inner tub 465 rotated by the rotating force of the motor 480. It is thus necessary to provide a means for supporting the heavy weight of the tub assembly 460 and absorbing the operational vibration and noise of the inner tub 465 during a rotating action.

The above object is accomplished by the damper units 475 provided at the upper ends of the four damper hangers 470. That is, the load, applied to the hangers 470 from the tilted assembly 460 during a washing operation, is effectively absorbed by the damper units 475. In such a case, it is necessary to design the damper units 475 to be free from any interference with the tub assembly 460. That is, the damper hangers 470, suspending the tilted tub assembly within the housing 450, are positioned while being inclined at an angle, with the damper units 475 having a volume. It is thus necessary to provide a space for the damper units 475, thereby preventing any interference between the damper units 475 and the tub assembly 460.

Particularly, in order to prevent any interference between the damper units 475 and the tub assembly 460 and to allow the washing machine, having a tilted tub assembly, to have the same capacity of laundry as expected from a typical washing machine, it is necessary to enlarge the volume of the housing 450.

The above object is accomplished by positioning the damper units 475 at an upper portion within the housing 450 in place of the lower portion. That is, the damper units 475, positioned at the upper portion within the housing 450, perform a desired damper function while being free from any interference with the tilted tub assembly 460.

During a washing operation, a load is applied from the tilted tub assembly 460 to the flanged stopper 477 of each rod 471. Since the stopper 477 is supported by the bracket 452 of the housing 450 through the coil spring 476, the damper units 470 effectively absorb the natural vibration of the tub assembly 460 and reduce the operational noise of the assembly 460 during a washing operation.

Figure 14:
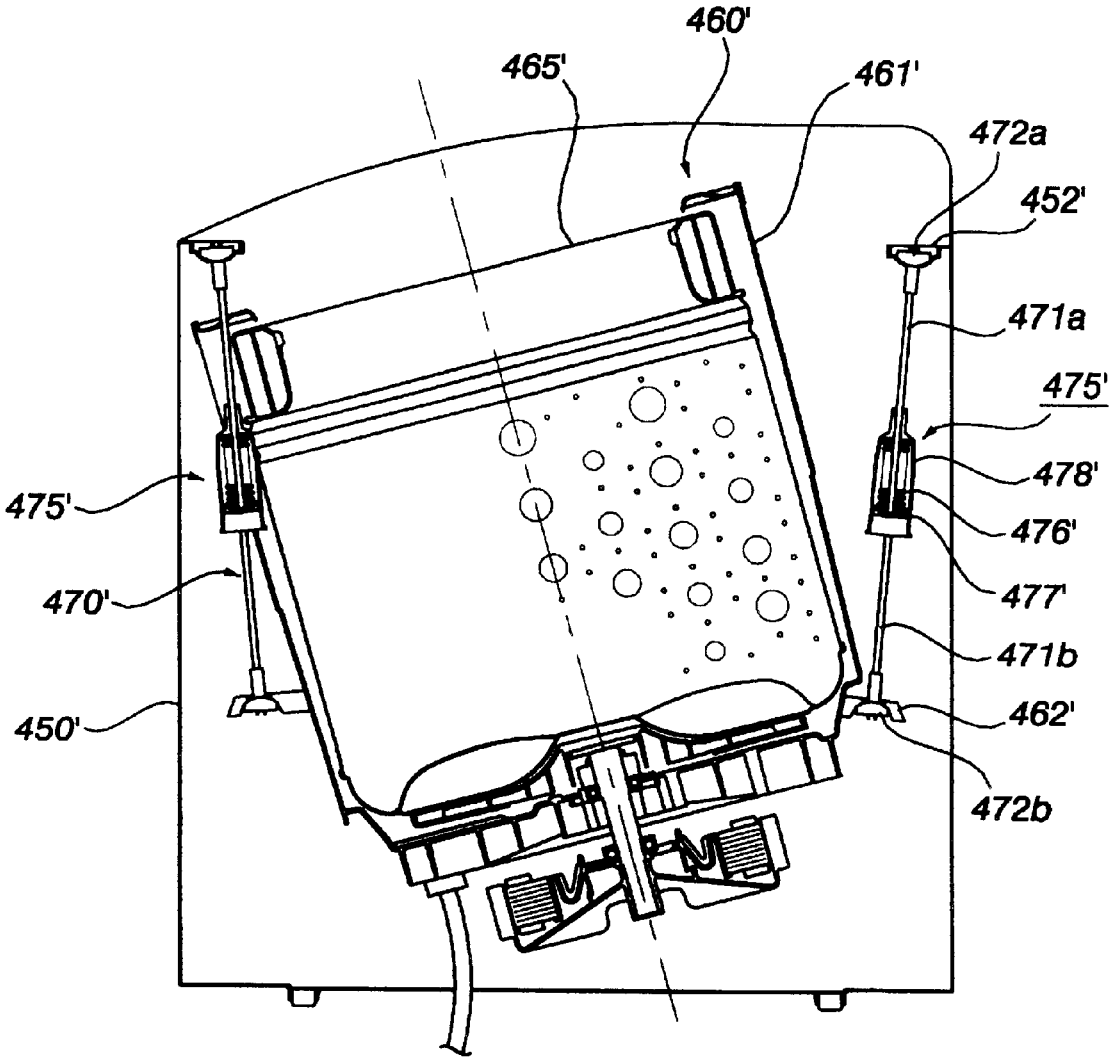
FIG. 14 is a side sectional view, showing the construction of a washing machine with a tilted tub assembly in accordance with the eleventh embodiment of this invention.

FIG. 14 is a side sectional view, showing the construction of a washing machine with a tilted tub assembly in accordance with the eleventh embodiment of this invention.

In the eleventh embodiment, each of the damper units 475' is provided at a middle portion of a damper hanger 470' different from the tenth embodiment having the damper units 475 at the upper ends of the hangers 470.

That is, the tub assembly 460', comprising outer and inner tubs 461' and 465', is suspended and supported within an upright housing 450' by four damper hangers 470' while being tilted at an angle of relative to the perpendicular of the housing 450'. Each of the hangers 470' comprises two rods 471*a* and 471*b* which are coupled together by a damper unit 475'.

Each of the damper units 475' comprises a hollow damper case 478', of which the bottom is fixed to the upper end of the lower rod 471*b*. The lower end of the upper rod 471*a* has a flanged stopper 477' and is axially inserted into the damper case 478', with a damper spring or a coil spring 476 being fitted over the lower end of the upper rod 471*a* and being stopped by the stopper 477' so as to be elastically retained within the case 478'. The damper units 475' individually perform a desired damper function by the damper spring 476'.

The top end of each upper rod 471*a* is caught by a housing bracket 452', interiorly formed on the upper portion of the housing 450', by a first locking flange member 472*a*. On the other hand, the lower end of each lower rod 471*b* is caught by a tub bracket 462', exteriorly formed on the lower portion of the outer tub 461', by a second locking flange member 472*b*.

When a load, caused by the tub assembly 460', is applied to both rods 471*a* and 471*b* of each hanger 470 in opposite directions, the load is absorbed by the damper springs 476' which are stopped by the stoppers 477' within the damper cases 478'. The damper units 470' thus effectively absorb the natural vibration of the tub assembly 460' and reduce the operational noise of the assembly 460' during a washing operation.

Of course, it should be understood that the damper hangers according to the tenth or eleventh embodiment may be preferably used with a conventional washing machine, having a vertical tub assembly, in addition to a washing machine with a tilted tub assembly.

As described above, the washing machine according to the tenth or eleventh embodiment has a damper unit 475, 475' at an upper or middle portion of each damper hanger 470, 470'. Such a damper unit 475, 475' is free from any interference with a tub assembly while reducing the volume of a washing machine, thus allowing desired capacity of laundry to a washing machine without enlarging the volume of the machine.

Figure 15:
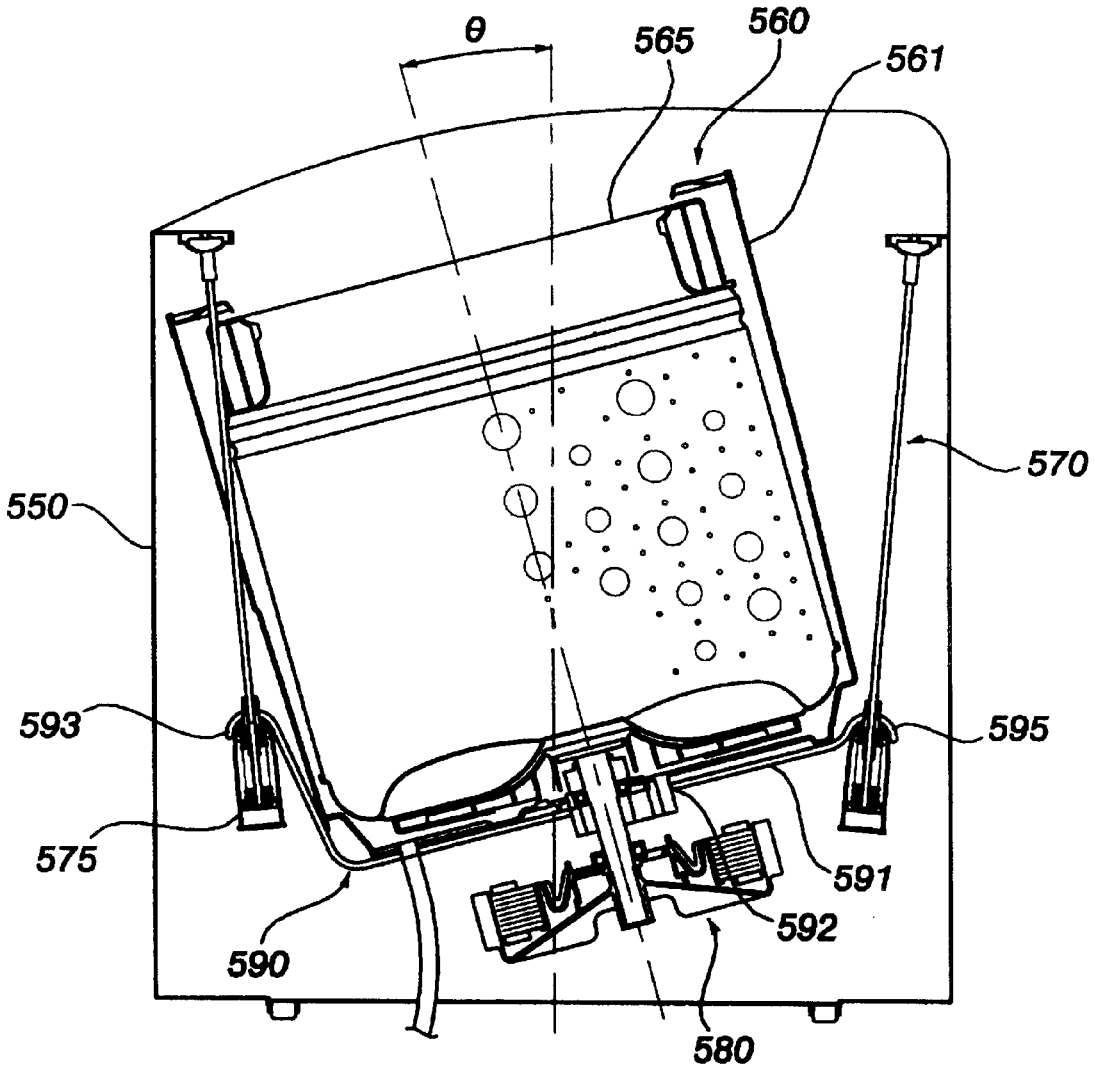
FIG. 15 is a side sectional view, showing the construction of a washing machine with a tilted tub assembly in accordance with the twelfth embodiment of this invention.
Figure 16:
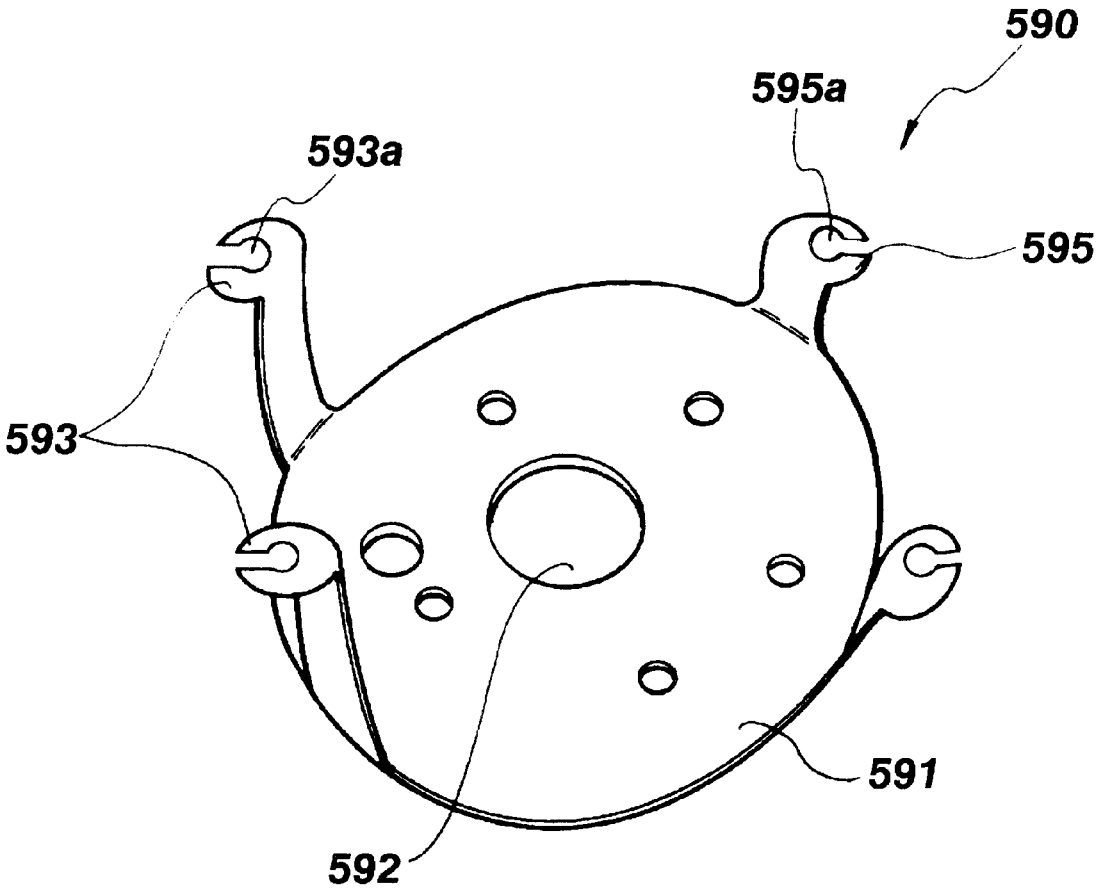
FIG. 16 is a perspective view of a lower frame of the tilted tub assembly of FIG. 15.

FIGS. 15 and 16 show the construction of a washing machine with a tilted tub assembly in accordance with the twelfth embodiment of this invention.

In the twelfth embodiment, the washing machine comprises an upright housing 550 having an opening at the top. A tub assembly 560, consisting of concentric outer and inner tubs 561 and 565, is suspended and supported inside the housing 550 by four damper hangers 570 while being tilted at angle of θ relative to the perpendicular of the housing 550. The upper end of each damper hanger 570 is interiorly held on the housing 550, while the lower end is exteriorly held on of the tub assembly 560. A drive motor 580 is provided at a position under the tilted tub assembly 560 for rotating the inner tub 565 of the tub assembly 560 during a washing operation of the washing machine.

A bottom frame 590 is exteriorly mounted to the bottom wall of the tilted tub assembly 560. A plurality of locking parts 593 and 595 are formed along the outside edge of the bottom frame 590 so as to hold the lower ends of the damper hangers 570.

As best seen in FIG. 16, the bottom frame 590 has an integrated structure. The above frame 590 comprises a disc-shaped support part 591 made of a metal. The frame 590 is exteriorly mounted to the bottom wall of the tub assembly 560 at the support part 591. Four locking parts 593 and 595 are formed along the outside edge of the bottom frame 590 at regularly spaced positions. Each of the above locking parts 593 and 595 extends upwardly from the edge of the support part 591 and has a hole 93*a*, 95*a* at an enlarged outside end, thus holding an associated damper hanger 570 at said outside end. Each of the enlarged outside ends of the locking parts 593 and 595 is radially slitted, thus forming a channel reaching an associated hole 93*a*, 95*a*.

A central opening 592 is formed at the center of the support part 591 so as to allow the output shaft of the motor 580 to pass through prior to being connected to the bottom wall of the inner tub 565. The output shaft of the motor 580 is rotatably supported by a bearing within the central opening 592.

In the above washing machine, the damper units 575, provided at the lower ends of the hangers 570, are positioned at the same height from the bottom wall of the upright housing 550 while supporting the tilted tub assembly 560 within the housing 550. The same height of the damper units 575 is accomplished by the locking parts 593 and 595 having different lengths. That is, the bottom frame 590 is designed to make the locking parts 593, positioned around the downward leaning portion of the tub assembly 560, longer than the other parts 595 positioned around the upward leaning portion of the assembly 560. The enlarged outside end of each locking part 593, 595 is concave at the bottom surface so as to more stably hold the top portion of an associated damper unit 575.

The above bottom frame 590 is preferably mounted to the exterior surface of the bottom wall of the tub assembly 560 using nuts and bolts.

In the washing machine according to the twelfth embodiment, the tub assembly 560 is tilted at an angle relative to the perpendicular of the upright housing 550, thus forming complex and active water currents in the same manner as that described for the other embodiments of this invention. This improves the washing effect while reducing the deviation of the washing effect.

However, when the tub assembly 560 is positioned while being tilted as described above, the load, acting on the hangers 570 due to the tub assembly 560, is not balanced. That is, the load, applied to the hangers 570 positioned around the downward leaning portion of the tilted assembly 560, is larger than that applied to the other hangers 570.

Therefore, it is necessary for the damper hangers to secure a balance while supporting the tilted tub assembly. When such a balance is not secured, the washing machine regrettably generates an upsetting operational vibration and noise due to an unbalance during a washing operation.

Such a balance is accomplished by the bottom frame 590, exteriorly mounted to the bottom wall of the outer tub 561 so as to support the lower portion of the tilted tub assembly 560 while securing the desired balance.

That is, the bottom wall of the tub assembly 560 is free from any reinforcing rib, but is exteriorly provided with the bottom frame 590. The above bottom frame 590 increases the strength of the bottom wall of the tub assembly 560, thus effectively supporting the load acting on the lower portion of the tub assembly 560.

In addition, the lower portions of the damper hangers 570 are held by the locking parts 593 and 595 integrally formed on the outside edge of the bottom frame 590. It is thus possible to easily and simply install the hangers 570 without causing any interference between the damper hangers 570 and the outer tub 561 of the tilted tub assembly 560.

Particularly, the outside ends of the locking parts 593 and 595 are positioned at the same height from the bottom wall of the upright housing 550. The bottom frame 590 thus secures a desired balance while supporting the bottom portion of the tilted tub assembly 560.

The bottom frame 590 also simplifies the external construction of the outer tub 561 and reinforces the lower support structure of the tub assembly 560. Another advantage of the above bottom frame 590 resides in that it has an integrated locking part, thus preferably removing any bracket for the hangers 570 from the tub assembly 560. Therefore, the bottom frame 590 allows the damper units to be free from any interference with the outer tub. The damper hangers are thus easily and simply installed within the washing machine.

As described above, the present invention provides a washing machine with a tilted tub assembly. In the washing machine, the tub assembly is tilted at a predetermined angle, thus being convenient to users while putting or taking laundry into or out of the tub assembly. Such a tilted tub assembly preferably forms complex and active water currents suitable for preventing laundry from being entangled during a washing operation. The tub assembly thus improves washing effect of the washing machine while reducing the deviation of the washing effect.

Due to the improved washing effect, the washing machine almost completely prevents the drive motor from being overloaded. The washing machine also conserves the operational time while washing laundry. This saves water and electric power during a washing operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine, comprising an upright housing, a washing tub assembly installed within said housing, and a plurality of longitudinal rod-shaped hangers holding said tub assembly within the housing in a tilted position with a longitudinal axis thereof substantially fixed at a predetermined angle relative to the perpendicular of the housing, each of said hangers being held on an upper portion of said housing at its upper end and being held on a lower portion of the tilted tub assembly at its lower end, wherein said hangers have the same length, and the lower ends of said hangers are held on the lower portion of the tilted tub assembly so as to be positioned at the same height from a horizontal bottom wall of the housing.

2. The washing machine according to claim 1, wherein said hangers are installed within the housing while being inclined at the same angle relative to horizontal surface.

3. The washing machine according to claim 1, wherein the lower ends of said hangers are held on a plurality of tub brackets provided at the lower portion of said tub assembly.

4. The washing machine according to claim 3, wherein a damper unit is provided at a lower end portion of each of said hangers for elastically supporting an associated tub bracket.

5. The washing machine according to claim 4, wherein said damper unit comprises:

elastic means provided on the lower end portion of each of said hangers;

a flange-shaped stopper provided at the lower end of each of the hangers for supporting a lower end of said elastic means; and a damper case provided at a position above the elastic means for elastically supporting an associated tub bracket in cooperation with the elastic means.

6. A washing machine according to claim 1, wherein said predetermined angle is less than about 33°.

7. A washing machine according to claim 6, wherein said predetermined angle is about 15°.

* * * * *